US009364050B2

(12) United States Patent
Bell

(10) Patent No.: US 9,364,050 B2
(45) Date of Patent: Jun. 14, 2016

(54) QUICK RELEASE WATCH BAND WITH FRANGIBLE STRUCTURES

(76) Inventor: Brian K. Bell, Lafayette, IN (US)

( * ) Notice: Subject to any disclaimer, the term of this patent is extended or adjusted under 35 U.S.C. 154(b) by 907 days.

(21) Appl. No.: 12/972,912

(22) Filed: Dec. 20, 2010

(65) Prior Publication Data

US 2011/0088224 A1 Apr. 21, 2011

Related U.S. Application Data

(63) Continuation of application No. 11/873,308, filed on Oct. 16, 2007, now Pat. No. 7,854,045.

(60) Provisional application No. 60/862,315, filed on Oct. 20, 2006.

(51) Int. Cl.

| | |
|---|---|
| ***A44C 5/14*** | (2006.01) |
| ***A44B 11/24*** | (2006.01) |
| ***A44C 5/20*** | (2006.01) |

(52) U.S. Cl.

CPC . *A44B 11/24* (2013.01); *A44C 5/20* (2013.01); *Y10T 24/47* (2015.01); *Y10T 24/4718* (2015.01); *Y10T 24/4782* (2015.01)

(58) Field of Classification Search

USPC ..... 24/265 WS, 906, 176, 177, 178, 180, 24/174, 163 R, 265 B

See application file for complete search history.

(56) References Cited

U.S. PATENT DOCUMENTS

| | | | | |
|---|---|---|---|---|
| 2,932,074 | A | 4/1960 | Resnick | |
| 4,044,725 | A | 8/1977 | Miller | |
| 4,180,016 | A | 12/1979 | George | |
| 4,564,308 | A | 1/1986 | Ikegami et al. | |
| 4,805,271 | A | 2/1989 | Ripley | |
| 4,858,283 | A * | 8/1989 | Takeuchi | 24/178 |
| D322,871 | S | 12/1991 | Heyman et al. | |
| 5,443,039 | A | 8/1995 | Suchowski | |
| 5,749,841 | A * | 5/1998 | Moore | 602/21 |
| 6,014,793 | A | 1/2000 | Howald | |
| 7,070,322 | B1 | 7/2006 | Field et al. | |
| 7,380,979 | B2 | 6/2008 | Hiranuma et al. | |
| 2006/0081665 | A1 * | 4/2006 | Nguyen et al. | 224/267 |

* cited by examiner

*Primary Examiner* — Robert J Sandy
*Assistant Examiner* — Michael Lee
(74) *Attorney, Agent, or Firm* — Barnes & Thomburg LLP

(57) ABSTRACT

A quick release jewelry band is configured to release a wristwatch from the wrist of a wearer if the watch band is subject to an excessive load which may injure the wearer.

9 Claims, 5 Drawing Sheets

QUICK RELEASE WATCH BAND WITH FRANGIBLE STRUCTURES

CROSS-REFERENCE TO RELATED APPLICATIONS

This application is a continuation of U.S. patent application Ser. No. 11/873,308 filed Oct. 16, 2007, which claims priority under 35 U.S.C. §119(e) to U.S. Provisional Application Ser. No. 60/862,315, filed Oct. 20, 2006, the disclosure of each of which is expressly incorporated by reference herein.

BACKGROUND OF THE INVENTION

The current disclosure relates to jewelry bands. More specifically, the current disclosure relates to jewelry bands, such as watch bands, for example, which have a quick release feature which causes the band to release if excessive force is applied to the watch band.

Jewelry bands in general and watch bands specifically are prone to catching or snagging on furniture or equipment when the band is worn by an active individual. If the band catches on an object, a wearer is susceptible to injury by the band.

SUMMARY OF THE INVENTION

The present disclosure comprises one or more of the features recited in the appended claims and/or the following features which, alone or in any combination, may comprise patentable subject matter:

A quick release band assembly is configured to release the first portion of a band from a second portion of the band assembly when an excessive load is applied to the band. In a first illustrative embodiment, a watch band assembly comprises a clasp assembly interconnecting a first portion of the watch band to a second portion of the watch band. The clasp assembly includes a cross-member engaged by a clasp when the watch band is secured to a user. The cross-member is rotatable about an axis of rotation to allow the clasp to slide past the cross-member and thereby release the watch band.

In a second illustrative embodiment, a hinge assembly interconnects a first portion of a band to a second portion of a band and the hinge member is configured to release the portions if a load applied to the hinge assembly exceeds a predefined maximum. Illustratively, the hinge assembly is spring-loaded and includes a hinge pin, a first engaging pin engaged with the hinge pin, a first spring urging the first engaging pin outwardly from the hinge pin, a second engaging pin engaged with the hinge pin, and a second spring urging the second engaging pin outwardly from the hinge pin.

In some embodiments, the first engaging pin engages a first member of the first portion and the second engaging pin engages a second member of the first portion to maintain the hinge assembly in engagement with the first portion. Illustratively, the first member of the first portion includes a first cavity configured to engage the first engaging pin, and the second member of the first portion includes a second cavity configured to engage the second engaging pin.

In still another illustrative embodiment, a clasp assembly may comprise a frangible hinge which is configured to fracture when an excessive load is placed upon a band. The hinge may comprise a plastic material. The failure point of a hinge may be adjusted by varying the geometry of a frangible intersection of the hinge or by varying the material used for the hinge or a combination thereof.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE INVENTION

Figure 1:
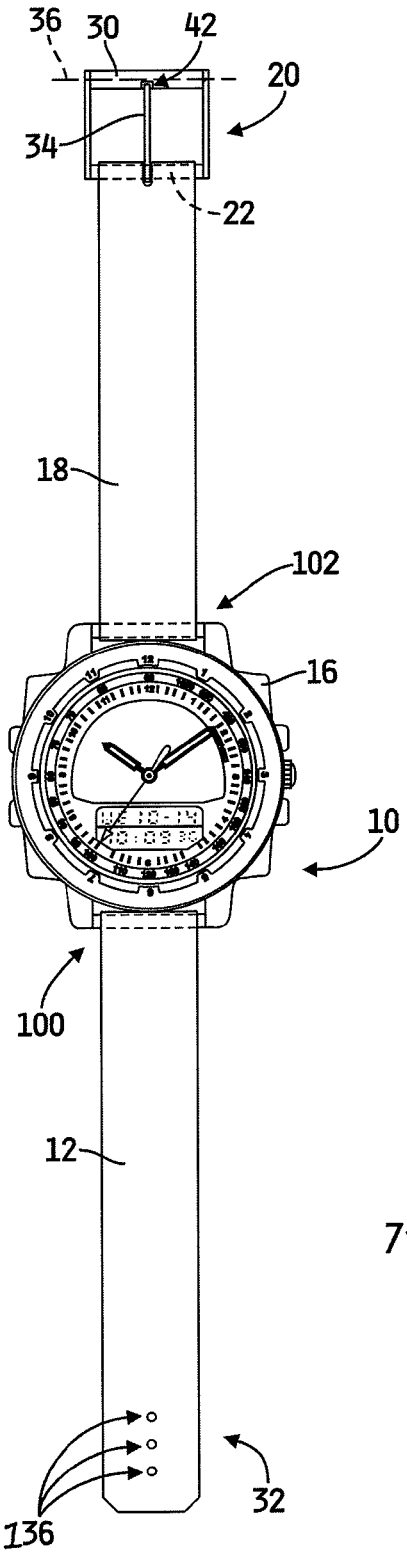
FIG. 1 is a plan view of a wrist-watch assembly including a first band, a watch coupled to the first band, a second band, and a clasp assembly coupled to the second band.

A wrist-watch assembly 10 includes a first band 12, a watch 16 coupled to the first band 12, a second band 18 coupled to the watch 16, and a clasp assembly 20 coupled to the second band 18 as shown in FIG. 1. In the illustrative embodiment of FIG. 1, wrist-watch assembly 10 is configured to be secured to the wrist of a wearer (not shown). The first band 12 is secured to the second band 20 by inserting a distal end 32 of first band 12 through the clasp assembly 20 and inserting clasp 34 through/a hole 136 in the first band 12. Clasp 34 rests against cross-member 30 of the clasp assembly 20 in the conventional way.

Figure 2:
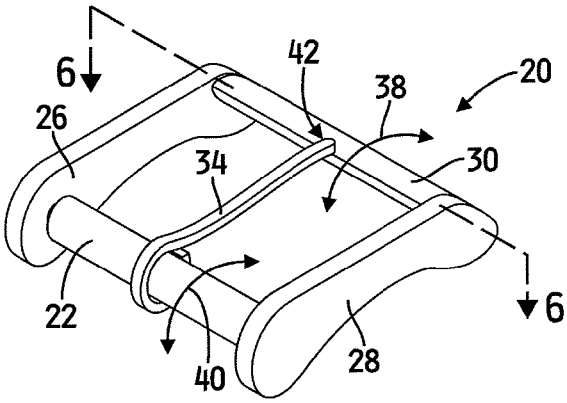
FIG. 2 is a perspective view of the clasp assembly of FIG. 1.

In the illustrative embodiment of FIG. 1, cross-member 30 is pivotable relative to the remainder of clasp assembly 20 about an axis 36 as depicted by arrow 38 in FIG. 2. Clasp 34 is pivotable about a hinge 22 of clasp assembly 20 as depicted by arrow 40. A distal end 42 of clasp 34 engages cross-member 30 when clasp 34 engages the first band 12 and is secured by the clasp assembly 20. Under normal conditions, clasp 34 engages and is held against cross-member 30 by a tension force in first band 12.

In the illustrative embodiment of FIG. 1, an excessive load on first band 12 increases the force exerted by the distal end 42 of clasp 34 and urges cross-member 30 to pivot about axis 36. Pivoting of cross-member 30 results in loss of the retaining action of clasp 34 with holes 136 in first band 12. Therefore first band 12 is released and wrist-watch assembly 10 is no longer retained on the wrist of an individual wearing the wrist-watch assembly 10.

Figure 4:
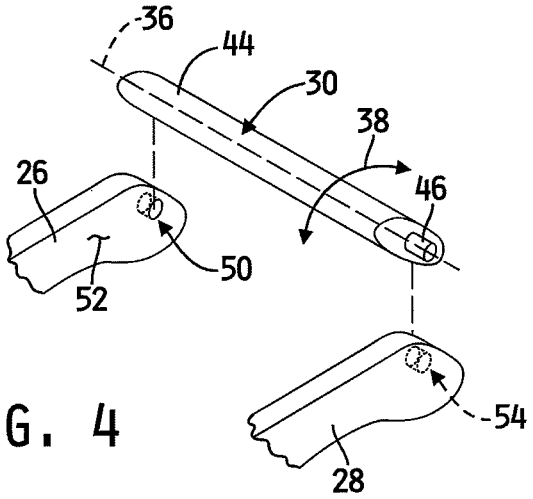
FIG. 4 is a partial exploded assembly view of the clasp assembly of FIGS. 1 and 2.
Figure 6:
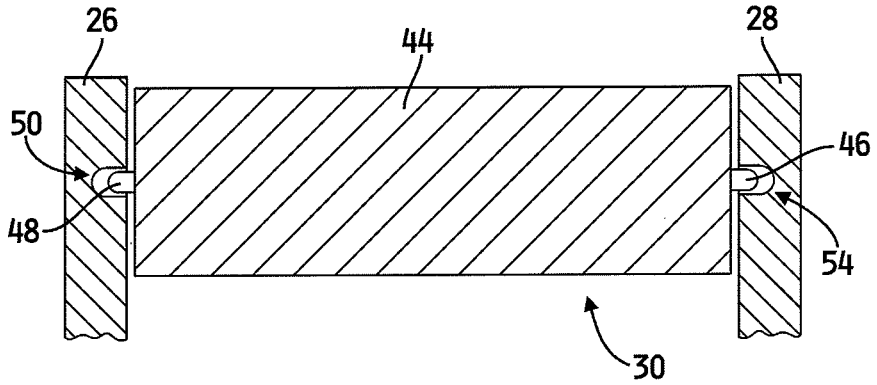
FIG. 6 is a partial cross-sectional view of the clasp assembly of FIG. 2 taken along lines 6-6.
Figure 7:
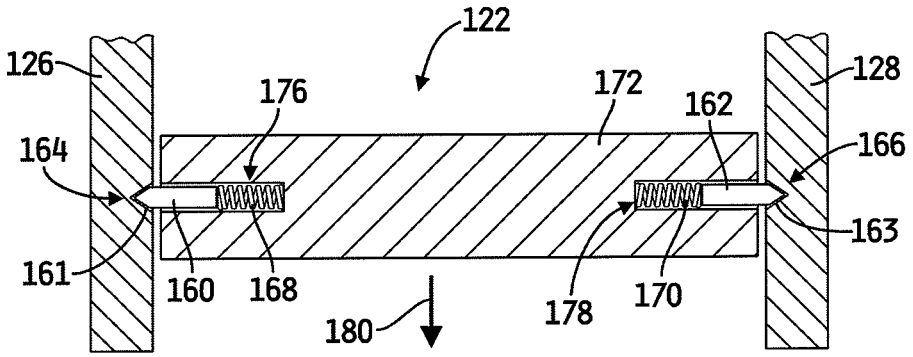
FIG. 7 is a partial cross-sectional view of the clasp assembly of FIG. 3 taken along lines 7-7.

Referring now to FIGS. 4 and 6, a main portion 44 of cross-member 30 has a substantially flattened cross-section when viewed along axis 36. A pivot 46 of cross-member 30 is coupled to main portion 44 and has a circular cross-section when viewed along axis 36. A second pivot 48 similar to pivot 46 is coupled to main portion 44 and extends from main portion 44 at the end opposite pivot 46. Clasp assembly 20 further comprises a first member 26 and a second member 28 which are coupled to hinge 22 in a generally parallel direction perpendicular to the longitudinal length of the hinge 22. First member 26 includes a blind cavity 50 with a circular cross-section formed in a surface 52 and open to the interior of the clasp assembly 20. Likewise, second member includes a blind cavity 54 with a circular cross-section open to the interior of clasp assembly 20. Pivot 46 is sized to be received in cavity 54 and pivot 48 (shown in FIG. 6) is sized to be received in cavity 50. When assembled, cross-member 30 pivots relative to members 26 and 28 as pivots 46 and 48 rotate within cavities 54 and 50, respectively.

Because distal end 42 of clasp 34 engages cross-member 30 without crossing the axis 36 of rotation of cross-member 30, the force applied to cross-member 30 by distal end 42 tends to urge cross-member 30 to rotate about axis 36. The frictional forces between cross-member 30 and first band 12 when first band 12 is secured by clasp assembly 20 causes wrist-watch 10 to be secured to the wrist of a wearer. In the illustrative embodiment, first band 12 and second band 18 comprise leather. It should be understood that first band 12 and second band 18 may comprise any of a number of materials. Likewise, cross-member 30 comprises metal but could be constructed of any of a number of suitable materials. The frictional relationship between cross-member 30 and first band 12 is a consideration in the proper release of clasp 34 in use.

In other embodiments, cross-member 30 may be spring-loaded such that a spring rate is determinative of the force necessary to permit clasp 34 to pass cross-member 30. In still other embodiments, clasp 34 may be constructed of a spring steel material or other resiliently flexible material that deflects under load to allow clasp 34 to slip past cross-member 30. In still other embodiments, clasp 34 may comprise a spring steel material or resiliently flexible material and cross-member 30 may be rotatable about axis 36 such that the combination of deflection of clasp 34 and rotation of cross-member 30 release first band 12 from clasp assembly 20.

Figure 3:
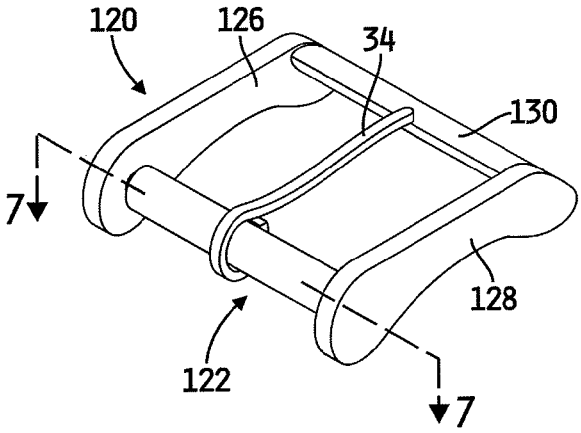
FIG. 3 is a perspective view of another embodiment of a clasp assembly.
Figure 5:
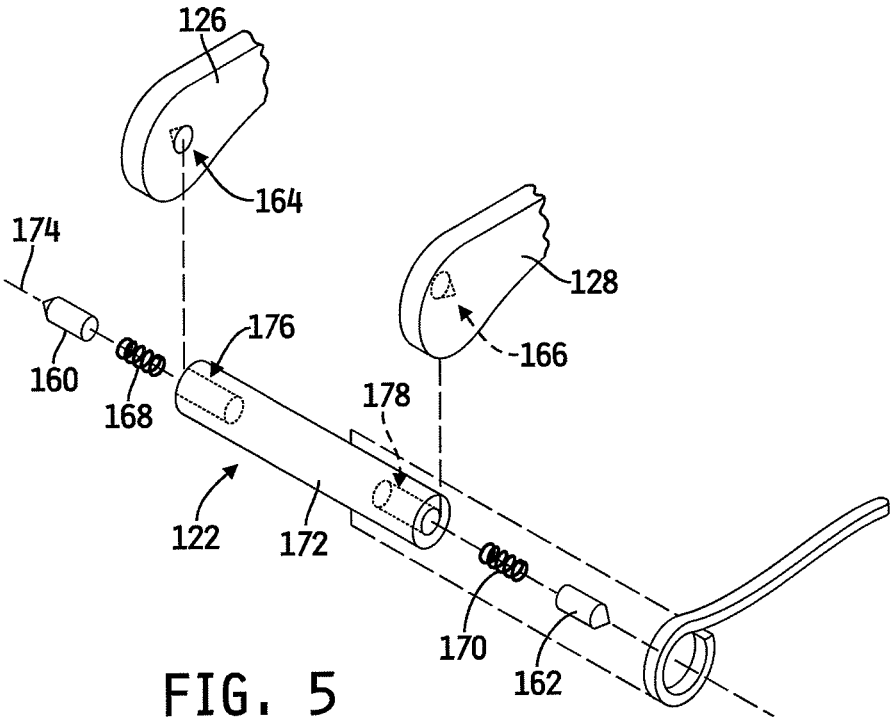
FIG. 5 is a partial exploded assembly view of the clasp assembly of FIG. 3.

In another embodiment of a quick release watch band, a clasp assembly 120 comprises a first member 126 coupled to a cross-member 130 and a second member 128 coupled to cross-member 130 opposite first member 126 as shown in FIG. 3. Clasp assembly 120 includes a clasp 34 supported on a hinge assembly 122 which is engaged with first member 126 and second member 128. Hinge assembly 122 is maintained in position through spring loading of two pins 160 and 162 by springs 168 and 170 respectively, as shown in FIGS. 3 and 5. Cross-member 130 is secured to first member 126 and second member 128 such that the three members form a U-shaped structure. Under load, hinge assembly 122 releases from members 126 and 128 and the wrist-watch is released from a user.

Referring now to FIG. 5, first member 126 includes a blind cavity 164 and second member 128 includes a blind cavity 166. Pin 160 is received in cavity 164 and pin 162 is received in cavity 166. Hinge assembly further comprises a hinge pin 172 which is an elongate member with a circular cross-section when viewed along a longitudinal axis 174. Hinge pin 172 is formed to include a blind cavity 176 formed in one end and a blind cavity 178 formed in the opposite end. Spring 168 and pin 160 is received in cavity 176 such that spring 168 urges pin 160 outwardly to engage cavity 164 of member 126. Likewise, spring 170 and pin 162 are received in cavity 178 such that spring 170 urges pin 162 outwardly to engage cavity 166 of member 128.

Cavities 164 and 166 comprise concave surfaces which are sized to engage convex surfaces 161 and 163 on pins 160 and 162 respectively. When a load is applied to hinge pin 172 as depicted by arrow 180 in FIG. 6, the force between the surfaces of cavities 164 and 166 are transferred to surface 161 and 163 and thereby urge pins 160 and 162 against springs 168 and 170 respectively. As springs 168 and 170 are deflected, pins 160 and 162 slip out of cavities 164 and 166 such that hinge assembly 122 is released from members 126 and 128, thereby releasing the wrist-watch from the user.

The force required to release the hinge assembly 122 is related to the spring rate of springs 168 and 170 and the interaction of the surfaces of cavities 164 and 166 and surfaces 161 and 163. Spring selection and the geometry of the surfaces of cavities 164 and 166 and surfaces 161 and 163 are selected such that the hinge assembly 122 to prevent unexpected release under normal conditions while causing release of the hinge assembly 122 under excessive loads.

While the surfaces 161 and 163 of pins 160 and 162 respectively are conical in shape, it should be understood that any of a number of surface shapes may be used. Likewise, the shape of the surfaces of cavities 164 and 166 may be varied within the spirit and scope of this disclosure. It should also be understood that the surface area of engagement between surfaces 161 and 163 with cavities 164 and 166 respectively may be varied to adjust the force necessary for the hinge assembly 122 to release from members 126 and 128.

While in the illustrative embodiment, hinge assembly 122 is positioned in clasp assembly 120, it should be understood that hinge assembly 122 may positioned elsewhere in the wrist-watch assembly. For example, wrist-watch assembly 10 shown in FIG. 1 has a hinge 100 between first band 12 and watch 16 and a hinge 102 between watch 16 and second band 18. A hinge assembly similar to hinge assembly 122 may be applied to either hinge 100 or hinge 102. In some embodiments, a wrist-watch may have plurality of hinge points and each hinge point may include a hinge assembly similar to hinge assembly 122.

Figure 8:
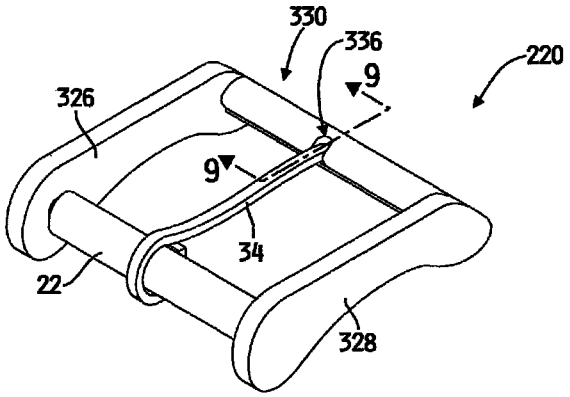
FIG. 8 is a perspective view of another embodiment of a clasp assembly.
Figure 9:
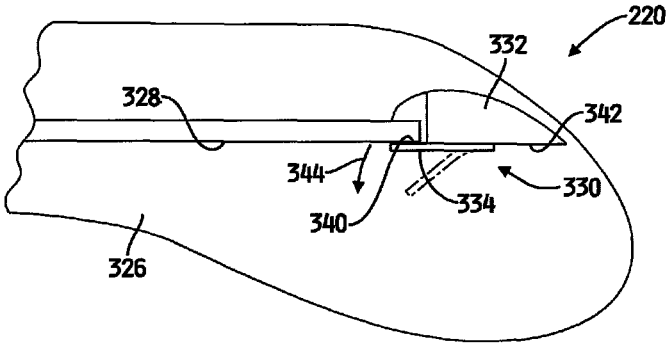
FIG. 9 is a partial cross-sectional view of the clasp assembly of FIG. 8 taken along lines 9-9.

In yet another embodiment, a clasp assembly 220 shown in FIGS. 8 and 9 is similar to clasp assembly 20. Clasp assembly 220 includes a release assembly 330. Release assembly 330 includes a cross-member 332 coupled to members 326 and 328 of the clasp assembly 220. Cross-member 332 is formed to include a notch 336 which is configured to receive distal end 42 of clasp 34. A flex member 334 is secured to a bottom surface 342 of cross-member 332 and is positioned to span notch 336 to form a support surface 340. A lower surface 338 of clasp 34 passes through notch 336 and is supported on support surface 340 of flex member 334. Flex member 334 is a constructed of a flexible material and is capable of flexing downwardly as indicated by arrow 344 in between the position shown in solid and the position shown in phantom in FIG. 9. When flex member 334 is in the position shown in phantom in FIG. 9, clasp 34 is released, thereby releasing a band secured by clasp 34. Illustratively, flex member 334 comprises a spring steel. In other embodiments, other materials having a sufficient flexibility to allow clasp 34 to be released under an excessive load may be chosen. For example, in some embodiments, flex member 334 may comprise a plastic material.

It is also contemplated that flex member 334 may comprise a heat sensitive material such as a bi-metallic material which releases and maintains the released position until sufficient heat is applied to return the material to a use position where clasp 34 may rest on the flex member. Also, while flex member 334 is illustratively a spring steel material, flex member 334 may comprise a first rigid portion coupled to a flexible portion such that the flexible portion deflects under load to release clasp 34. For example, a rigid member may be secured to a torsion spring or other spring member which is secured to cross-member 332 such that the rigid member is movable relative to the cross-member 332.

Figure 10:
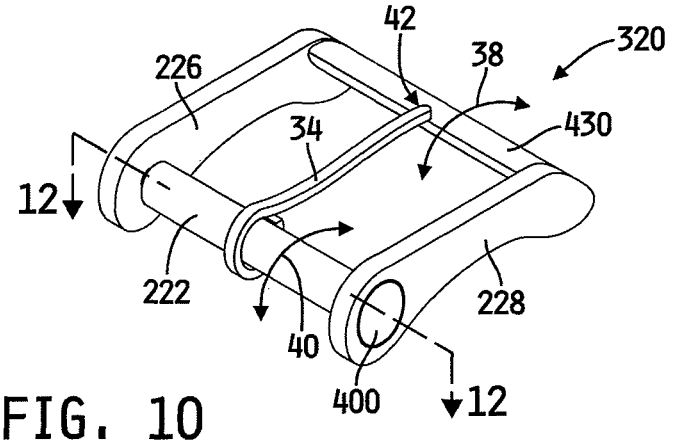
FIG. 10 is a perspective view of yet another embodiment of a clasp assembly.
Figure 11:
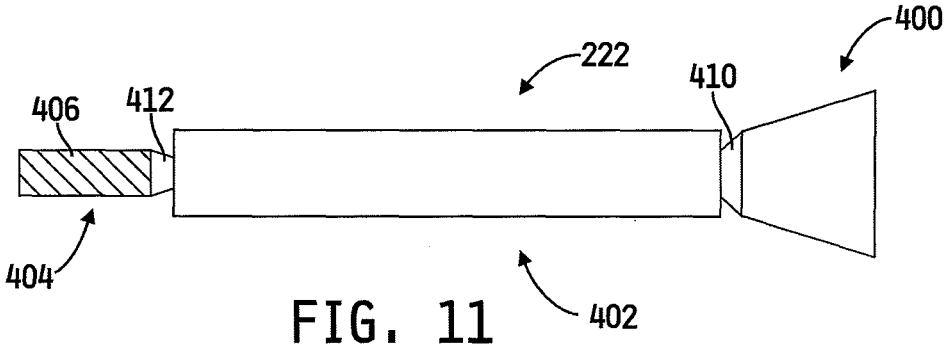
FIG. 11 is an elevation view of a cross-member for the clasp assembly shown in FIG. 10.
Figure 12:
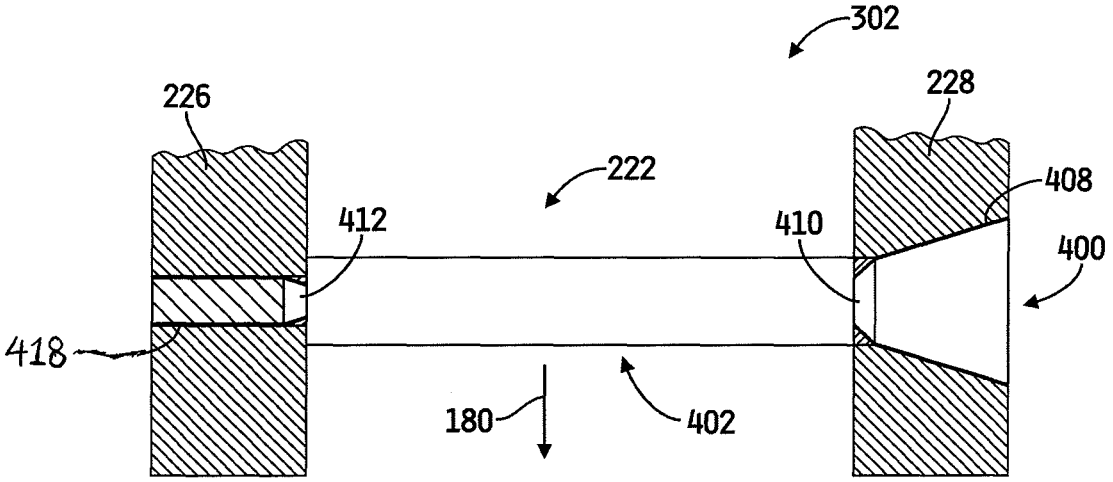
FIG. 12 is a cross-sectional view of the clasp assembly of FIG. 10 taken along lines 12-12.

In still another embodiment shown in FIGS. 10-12, a clasp assembly 320 is similar to clasp assembly 20 and includes a cross-member 430 which is coupled to a first member 226 and a second member 228. Unlike the embodiment of FIG. 2, cross-member 430 does not rotate relative to members 226 and 228. Clasp assembly 320 includes a hinge 222 which is frangible and configured to fail under an excessive load on a band supported on the hinge 222.

Referring now to FIG. 11, hinge 222 includes a head 400, a shaft 402 coupled to the head 400, and a pin 404 coupled to the shaft 402. Pin 404 includes a knurled surface 406 which is received in a hole 418 in member 226. Head 400 is configured to be received in a countersink 408 in member 228 as hinge 222 is inserted through member 228 and pin 404 is received in member 226. The knurled surface 406 of pin 404 results in an interference fit between pin 404 and member 226 such that hinge 222 is retained relative to members 226 and 228 during normal use.

Head 400 is formed with an annular surface 410 formed at an intersection between head 400 and shaft 402 such that hinge 222 is frangible at the intersection of head 400 and shaft 402. Likewise, pin 404 is formed with an annular surface 412 formed at the intersection between pin 404 and shaft 402 such that hinge 222 is frangible at the intersection of pin 404 and shaft 402. Thus, when a force is applied to a band in the direction of arrow 180 as shown in FIG. 12, the intersection of shaft 402 to pin 404 will fail to permit the band to be released. Additional force or displacement will result in the failure of the frangible intersection of head 400 and shaft 402. This is because the material connecting head 400 to shaft 402 has a larger cross-section than the material connecting pin 404 to shaft 402. In the illustrative embodiment, the hinge 222 comprises ABS which has brittle characteristics. It should be understood that in other embodiments, the hinge 222 may comprise any of a number of brittle materials such as plastics or metals. The force with which the hinge 222 will release may be adjusted for particular applications by varying the material and the cross-sectional area connecting the pin 404 to shaft 402 and head 400 to shaft 402. Once a hinge 222 fails, a new hinge 222 is easily installed as the head 400 will no longer be retained and a replacement hinge 222 will displace the pin 404 when the hinge 222 is inserted into the clasp assembly 320.

In some embodiments, the pin 404 may comprise external threads and the member 228 may comprise internal threads configured to receive the external threads of the pin 404 to secure the hinge 222. In the illustrative embodiment pin 404 includes a knurled outer surface. In some embodiments, the knurling may be omitted and the pin 404 may be sized to secure the hinge 222 to the clasp assembly 320 through a simple interference fit.

A wrist-watch employing a clasp assembly similar to clasp assemblies 20, 120, 220 or 320 may be suitable for use in certain working conditions such as occupations which run the risk of entanglement of jewelry in machinery or equipment. In some situations, a quick release watch band may reduce the potential for injury if the watch band is entangled or otherwise caught on equipment or machinery.

While the illustrative embodiments of the present disclosure are watch bands, it should be understood that the quick release features of the present disclosure may be applied to any of a number of band assemblies worn by an individual. For example, the quick release feature may be implemented in bracelets, necklaces, hair accessories, belts, shoulder straps or the like.

Although certain illustrative embodiments have been described in detail above, variations and modifications exist within the scope and spirit of this disclosure as described and as defined in the following claims.

The invention claimed is:

1. A quick release band for a wrist-watch, the band comprising a first portion, a second portion, and a hinge connecting the first portion to the second portion, the hinge including a plurality of frangibility structures configured to release the first and second portions if a load applied to the hinge exceeds a predefined maximum, wherein the hinge comprises a plurality of the frangible structures with a first frangible structure configured to fail at a first force and a second frangible structure configured to fail at a second force, the second force greater than the first force.

2. The quick release band of claim 1, wherein the plurality of frangible structures are removable.

3. A quick release band for a wrist-watch, the band comprising a first portion, a second portion, and a hinge connecting the first portion to the second portion, the hinge including a frangible structure configured to release the first and second portions if a load applied to the hinge exceeds a predefined maximum, wherein the frangible structure is removable.

4. A wristwatch assembly comprising a plurality of frangible structures that fails if a load applied to the frangible structure exceeds a predefined maximum, wherein the wristwatch assembly comprises a plurality of the frangible structures, each of the respective frangible structures failing if a load applied to the one of the frangible structure exceeds a predefined maximum, the predefined maximum load for each respective frangible structure being a value that is not equal to the value of the predefined maximum load for each of the other of the plurality of frangible structures.

5. The wristwatch assembly of claim 4, wherein each of the frangible structures is removable.

6. A wristwatch assembly comprising a frangible structure that fails if a load applied to the frangible structure exceeds a predefined maximum, wherein the frangible structure is removable.

7. The wristwatch assembly of claim 6, wherein the frangible structure is removable and may be replaced with a replacement frangible structure that has a predefined maximum load that is different from the predefined maximum load of the original frangible structure.

8. The wristwatch assembly of claim 7, wherein the replacement frangible structure has a longitudinal axis and the frangible structure fails if a load that is applied to the structure in a direction that is generally perpendicular to the longitudinal axis of the frangible structure exceeds a predefined maximum.

9. A jewelry band comprising a band, and a connector for securing the band, the connector including a plurality of frangibility structures configured to release the band if a load applied to the connector exceeds a predefined maximum, wherein the connector comprises a plurality of the frangible structures, each of the frangible structures failing respectively if a load applied to one of the respective frangible structures exceeds a predefined maximum, the predefined maximum load for each respective frangible structure being a value that is not equal to the value of the predefined maximum load for each of the other of the plurality of frangible structures.

* * * * *